US009855601B2

(12) United States Patent
Ahlin et al.

(10) Patent No.: US 9,855,601 B2
(45) Date of Patent: Jan. 2, 2018

(54) LUBRICANT FOR POWDER METALLURGICAL COMPOSITIONS

(75) Inventors: Åsa Ahlin, Höganäs (SE); Anna Ahlquist, Höganäs (SE); Karin Olsson, Helsingborg (SE)

(73) Assignee: HÖGANÄS AB (PUBL), Höganäs (SE)

( * ) Notice: Subject to any disclaimer, the term of this patent is extended or adjusted under 35 U.S.C. 154(b) by 858 days.

(21) Appl. No.: 13/129,837

(22) PCT Filed: Nov. 25, 2009

(86) PCT No.: PCT/SE2009/051336

§ 371 (c)(1),
(2), (4) Date: Jun. 15, 2011

(87) PCT Pub. No.: WO2010/062250

PCT Pub. Date: Jun. 3, 2010

(65) Prior Publication Data

US 2011/0265602 A1 Nov. 3, 2011

Related U.S. Application Data

(60) Provisional application No. 61/193,823, filed on Dec. 29, 2008.

(30) Foreign Application Priority Data

Nov. 26, 2008 (SE) ..... 0802486

(51) Int. Cl.
*C10M 103/06* (2006.01)
*B22F 1/00* (2006.01)
(Continued)

(52) U.S. Cl.
CPC ..... *B22F 1/0059* (2013.01); *C22C 33/0264* (2013.01); *B22F 2003/023* (2013.01); *B22F 2998/10* (2013.01)

(58) Field of Classification Search
USPC ..... 75/252
See application file for complete search history.

(56) References Cited

U.S. PATENT DOCUMENTS 5,554,338 A 9/1996 Sugihara et al.
5,782,954 A * 7/1998 Luk ..... 75/252
(Continued)

FOREIGN PATENT DOCUMENTS

EP 0 899 043 A1 3/1999
JP 2003-338526 A 11/2003
(Continued)

OTHER PUBLICATIONS

International Search Report (PCT/ISA/210) dated Mar. 10, 2010, by Swedish Patent Office as the International Searching Authority for International Application No. PCT/SE2009/051336.
(Continued)

*Primary Examiner* — Jenny Wu
(74) *Attorney, Agent, or Firm* — Buchanan Ingersoll & Rooney P.C.

(57) ABSTRACT

An iron-based powder metallurgical composition is provided comprising an iron or iron-based powder and composite lubricant particles, with the composite lubricant particles comprising a core of 10-60% by weight of at least one primary fatty acid amide having more than 18 and not more than 24 carbon atoms and 40-90% by weight of at least one fatty acid bisamide, with the core having nanoparticles of at least one metal oxide adhered thereon. Further provided is a particulate composite lubricant as well as a method of preparing such lubricant.

17 Claims, 5 Drawing Sheets

(51) Int. Cl.

| | |
|---|---|
| ***C22C 38/00*** | (2006.01) |
| ***B82Y 30/00*** | (2011.01) |
| ***C22C 33/02*** | (2006.01) |
| *B22F 3/02* | (2006.01) |

(56) References Cited

U.S. PATENT DOCUMENTS

| | | | | |
|---|---|---|---|---|
| 5,976,215 | A | 11/1999 | Uenosono et al. | |
| 6,395,688 | B2 | 5/2002 | Vidarsson | |
| 6,413,919 | B2 | 7/2002 | Vidarsson | |
| 6,436,166 | B2 * | 8/2002 | Arvidsson | 419/36 |
| 2005/0139039 | A1 | 6/2005 | Larsson et al. | |
| 2006/0099104 | A1 * | 5/2006 | McCall | 419/37 |
| 2008/0302209 | A1 | 12/2008 | Knutsson et al. | |
| 2009/0107292 | A1 | 4/2009 | Ahlin et al. | |

FOREIGN PATENT DOCUMENTS

| | | | |
|---|---|---|---|
| JP | 2005-105323 | A | 4/2005 |
| JP | 2008-266776 | A | 11/2008 |
| WO | WO 2005/061157 | A1 | 7/2005 |
| WO | WO 2007/078228 | A1 | 7/2007 |
| WO | WO 2007/078232 | A1 | 7/2007 |

OTHER PUBLICATIONS

Written Opinion (PCT/ISA/237) dated Mar. 10, 2010, by Swedish Patent Office as the International Searching Authority for International Application No. PCT/SE2009/051336.

* cited by examiner

LUBRICANT FOR POWDER METALLURGICAL COMPOSITIONS

TECHNICAL FIELD OF THE INVENTION

The present invention relates to a powder metallurgical composition. Specifically, the invention relates to a powder metal composition comprising a new particulate composite lubricant. The invention further relates to the new particulate composite lubricant as well as a method of preparing this lubricant.

BACKGROUND ART

In the Powder Metallurgy industry (PM industry) powdered metals, most often iron-based, are used for production of components. The production process involves compaction of a powder metal blend in a die to form a green compact, ejecting the compact from the die and sintering the green compact at temperatures and under such conditions that a sintered compact having sufficient strength is produced. By using the PM production route costly machining and material losses can be avoided compared to conventional machining of components from solid metals as net shape or nearly net shape components can be produced. The PM production route is most suitable for the production of small and fairly intricate parts such as gears.

In order to facilitate the production of PM parts lubricants may be added to the iron-based powder before compaction. By using lubricants, the internal frictions between the individual metal particles during the compaction step are reduced. Another reason for adding lubricant is that the ejection force and the total energy needed in order to eject the green part from the die after compaction are reduced. Insufficient lubrication will result in wear and scoring at the die during the ejection of the green compact leading to destruction of the tool.

The problem with insufficient lubrication can be solved mainly in two ways, either by increasing the amount of lubricant or by selecting more efficient lubricants. By increasing the amount of lubricant, an undesired side effect is however encountered in that the gain in density through better lubrication is reversed by the increased amount of the lubricants. A better choice would then be to select more efficient lubricants.

U.S. Pat. No. 6,395,688 to Vidarsson describes a process for producing a composite lubricant including a meta stable phase of a first lubricant chosen from saturated and unsaturated fatty acid amides or bisamides and a second lubricant chosen from the group of fatty acid bisamides. By melting the components and subjecting the melt to rapid cooling a meta stable lubricating phase is obtained.

U.S. Pat. No. 6,413,919 to Vidarsson discloses a process for the preparation of lubricant combination including the steps of selecting a first lubricant and a second lubricant, mixing the lubricants and subjecting the mixture to such conditions that the surface of the first lubricant is coated with the second lubricant.

Japanese patent application 2003-338526, publication no 2005-105323, teaches a lubricant combination of a core material of a low melting point lubricant, the surface thereof covered with particles of a high melting point lubricant.

WO 2007078228 describes an iron-based powder composition containing a lubricant which contains a lubricating core having the surface thereof coated with fine particulate carbon material.

SUMMARY OF THE INVENTION

An objective of the present invention is to obtain an improved particulate lubricant. Other objectives and advantages of the present invention will be apparent from the following.

According to an aspect of the invention, there is provided an iron-based powder metallurgical composition comprising an iron or iron-based powder and composite lubricant particles, said composite lubricant particles comprising a core of 10-60% by weight of at least one primary fatty acid amide having more than 18 and not more than 24 carbon atoms and 40-90% by weight of at least one fatty acid bisamide, said lubricant particles also comprising nanoparticles of at least one metal oxide adhered on the core.

According to another aspect of the invention, there is provided a particulate composite lubricant particle comprising a core of 10-60% by weight of at least one primary fatty acid amide having more than 18 and not more than 24 carbon atoms and 40-90% by weight of at least one fatty acid bisamide, said lubricant particle also comprising nanoparticles of at least one metal oxide adhered on the core.

According to another aspect of the invention, there is provided a method for producing composite lubricant particles, comprising: mixing 10-60% by weight of at least one primary fatty acid amide having more than 18 and not more than 24 carbon atoms and 40-90% by weight of at least one fatty acid bisamide; melting the mixture; disintegrating the mixture to form cores of composite lubricant particles; and adhering nanoparticles of at least one metal oxide on the cores.

DETAILED DESCRIPTION OF THE INVENTION

Figure 1:
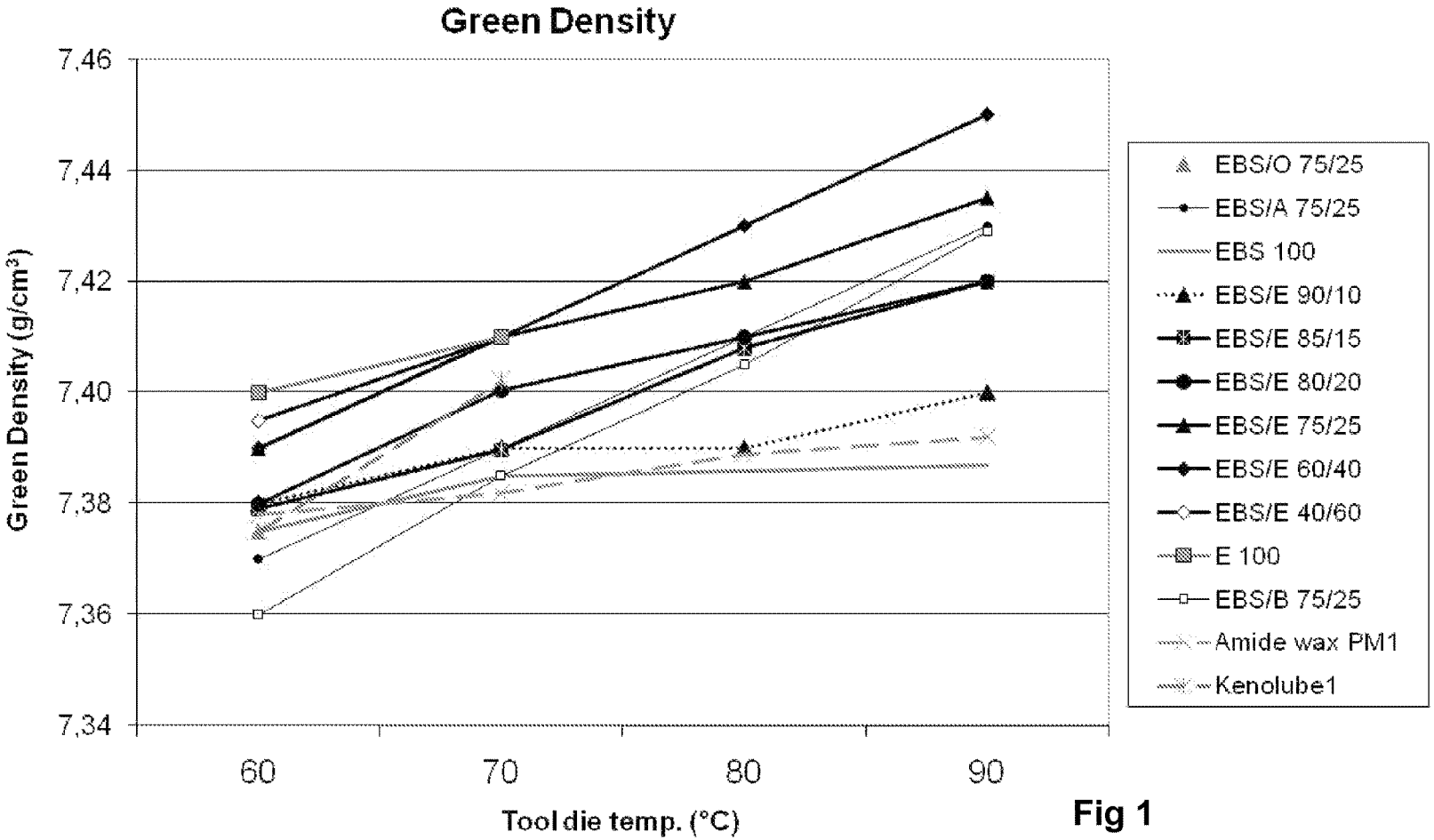
FIG. 1 is a graph showing the obtained green density for different lubricant composites at different tool die temperatures.

The lubricant composite according to the invention comprises at least one primary fatty acid amide. The primary fatty acid amide should contain more than 18 carbon atoms and not more than 24, for example less than 24, carbon atoms. If the number of carbon atoms is 18 or less, the composite lubricant tends to form agglomerates during storage and the compacted part will have a tacky surface. The at least one primary fatty acid amide may be selected from the group consisting of arachidic acid amide, erucic acid amide and behenic acid amide.

The concentration of the at least one primary fatty acid amide in the core of the composite lubricant particle may be 5-60%, conveniently 10-60%, preferably 13%-60%, more preferably 15-60%, by weight of the composite lubricant, or 10-40% by weight such as 10-30% by weight. A concentration of primary fatty acid amide below 10% may impair the lubricating properties of the components of the particulate composite lubricant resulting in scratches of the surfaces of a compacted powder metallurgical component and of the compaction die, and a concentration above 60% will render the composite lubricant a tacky "texture" leading to bad flow of an iron-based powder metallurgical composition comprising the composite lubricant particles, as well as of the particulate composite lubricant itself, and to an increased tendency to form agglomerates during storage. A concentration of primary fatty acid amide above 60% will also render a tacky surface of the compacted component resulting in that contaminating particles will stick to the surface of the compacted component.

The composite further comprises at least one fatty acid bisamide. The fatty acid bisamide may be selected from the group consisting of methylene bisoleamide, methylene bisstearamide, ethylene bisoleamide, hexylene bisstearamide and ethylene bisstearamide (EBS).

The concentration of the at least one fatty acid bisamide in the core of the composite lubricant particle may be 40-95% by weight, such as 40-90% by weight, or 60-95% by weight, such as 60-90% or 70-90% by weight, or 60-87%, such as 60-85%, by weight of the composite lubricant.

The core of the composite lubricant particle may consist only of the at least one primary fatty acid amide and the at least one fatty acid bisamide, but alternatively the core may include one or more ingredients in addition to the at least one primary fatty acid amide and the at least one fatty acid bisamide.

The lubricant core may further have nanoparticles of at least one metal oxide adhered thereon. The metal oxide may be selected from the group consisting of $TiO_2$, $Al_2O_3$, $SnO_2$, $SiO_2$, $CeO_2$ and indium titanium oxide. The nanoparticles of the at least one metal oxide may have a primary particle size less than 500 nm, such as less than 200 nm.

The concentration of the composite lubricant according to the invention may be in the range of 0.01-2%, conveniently 0.05-2%, preferably 0.2-2%, more preferably 0.2-1%, such as 0.4-0.7%, by weight of the iron-based powder metallurgical composition.

The lubricant composite particles may be prepared by melting together the components, i.e. fatty acid amide and fatty acid bisamide, followed by a disintegration step, resulting in discrete particles which may form cores of the lubricant composite particles. The disintegration may e.g. be performed through atomisation of a melt by gas or liquid medium or through micronisation, i.e. grinding, of a solidified mixture. The obtained lubricant core particles may have a mean particle size of 1-50 μm, preferably 5-40 μm. After the disintegration step the core particles of the lubricant composite may be combined with, e.g. gently mixed with, nanoparticles of at least one metal oxide such that the nanoparticles adhere on the cores of the composite lubricant particles. The concentration of metal oxide in the composite lubricant may be 0.001-10%, preferably 0.01-5%, more preferably 0.01-2% by weight of the composite lubricant. The mixing step may include heating of the composite lubricant up to a temperature below the melting point of the low melting component. An alternative method of producing the composite lubricant is to physically mix the fatty acid amides with the bisamides, without heating.

The iron-based powder may be a pre-alloyed iron-based powder or an iron-based powder having the alloying elements diffusion-bonded to the iron-particles. The iron-based powder may also be a mixture of essentially pure iron powder or pre-alloyed iron-based powder and alloying elements selected from the group consisting of Ni, Cu, Cr, Mo, Mn, P, Si, V, Nb, Ti, W and graphite. Carbon in the form of graphite is an alloying element used to a large extent in the PM industry in order to give sufficient mechanical properties to the finished sintered components. By adding carbon as an individual constituent to the iron-based powder composition the content of dissolved carbon of the iron-based powder can be kept low improving the compressibility. The iron-based powder may be an atomized powder, such as a water atomized powder, or a sponge iron powder. The particle size of the iron-based powder is selected depending on the final use of the material. The particles of the iron or iron-based powder normally has a weight average particle size up to about 500 μm and above 10 μm, preferably above 30 μm.

The powder metallurgical composition may further comprise one or more additives selected from the group consisting of binders, processing aids, hard phases, machinability enhancing agents if there is a need of machining of the sintered component.

The iron-based powder metallurgical composition comprises the iron or iron-based powder and composite lubricant particles. The iron or iron-based powder may be mixed with the composite lubricant particles. The composite lubricant particles may be bound to the particles of the iron or iron-based powder, e.g. by means of a binder or without additional binder, but it may be preferred not to have the composite lubricant particles bound to the particles of the iron or iron-based powder, i.e. an unbound composition where the composite lubricant is in a free particulate form.

The new iron or iron-based powder metallurgical composition may be compacted and optionally sintered according to conventional PM techniques.

The following examples serve to illustrate the invention but the scope of the invention should not be limited thereto.

EXAMPLES

Materials

The following materials were used;

Various composite lubricants were prepared by mixing substances, according to table 1 and in proportions according to table 2. The substances were thereafter melted and subsequently solidified and micronised to a mean particle size between 15-30 μm. The micronised materials were treated with a 0.3% by weight fine particulate silicon dioxide having a primary particle size less than 200 nm.

As reference materials the known lubricants Kenolube® P11, available from Höganäs A B, and Amide Wax P M, available from Höganäs A B, were used. Kenolube® P11 is a Zn-containing organic lubricant and Amide Wax PM is an organic lubricant based on ethylene bisstearamide, EBS.

In order to measure the tendency of the composite lubricants and the conventional lubricants to form agglomerates, the lubricants were sieved on a standard 315 μm sieve after storage during 28 days at a temperature of 50° C. and a relative humidity of 90%. The amount of the retained material on the sieve was measured and the results are disclosed in Table 3.

TABLE 1

Substances used to form composite lubricants.

| Mark | Common name | No of C-atoms of the primary amide | Saturated | Unsaturated |
|---|---|---|---|---|
| EBS | Ethylene bisstearamide | N.A. | | |
| O | Oleic acid amide | 18 | | x |
| A | Arachidic acid amide | 20 | x | |

TABLE 1-continued

Substances used to form composite lubricants.

| Mark | Common name | No of C-atoms of the primary amide | Saturated | Unsaturated |
|---|---|---|---|---|
| E | Erucic acid amide | 22 | | x |
| B | Behenic acid amid | 22 | x | |

TABLE 2

Contents of organic substances of composite lubricants.

| Lubricant | % by weight of EBS | % by weight of primary amide |
|---|---|---|
| 75/25 EBS/O | 75 | 25 |
| 100 EBS | 100 | 0 |
| 75/25 EBS/A | 75 | 25 |
| 90/10 EBS/E | 90 | 10 |
| 85/15 EBS/E | 85 | 15 |
| 80/20 EBS/E | 80 | 20 |
| 75/25 EBS/E | 75 | 25 |
| 60/40 EBS/E | 60 | 40 |
| 40/60 EBS/E | 40 | 60 |
| 100 E | 0 | 100 |
| 75/25 EBS/B | 75 | 25 |

TABLE 3

Tendency to form agglomerate during storages.

| Lubricant | Storages 0 days wt % > 150 μm | Storages 28 days wt % > 150 μm |
|---|---|---|
| 75/25 EBS/O[2] | 0 | 28 |
| 75/25 EBS/A | 0 | 0.04 |
| 100 EBS[2] | 0 | 0.00 |
| 90/10 EBS/E | 0 | 0.00 |
| 85/15 EBS/E | 0 | 0.04 |
| 80/20 EBS/E | 0 | 0.06 |
| 75/25 EBS/E | 0 | 0.51 |
| 60/40 EBS/E | 0 | 0.80 |
| 40/60 EBS/E | 0 | 2.5 |
| 100 E[2] | 0 | 5.0 |
| 75/25 EBS/B | 0 | 0.02 |

[2]Outside the scope of the invention

Table 3 shows that particulate composite lubricants according to the invention can be stored without agglomeration. The agglomeration was surprisingly found to be affected by both the relative concentrations of EBS and fatty acid amide as well as the amount of carbon atoms in the fatty acid amide.

Preparation of Iron-Based Powder Compositions;

As iron or water-atomized iron-based powders, DistaloyAE®, Astaloy®CrM, and a water atomized pure iron powder, ASC100.29, all available from Höganäs A B, Sweden, were used. Distaloy®AE consists of a pure iron having particles of Ni, Cu and Mo bonded to the surface by diffusion annealing (4% by weight Ni, 1.5% by weight Cu and 0.5% by weight Mo). Astaloy®CrM is a water-atomized prealloyed powder containing 3% Cr and 0.5% Mo Graphite UF-4 (from Kropfmuhl AG, Germany) was used as added graphite in the iron-based powder composition.

Iron-based powder compositions of 25 kg each were prepared by mixing 0.5% by weight of the different particulate composite lubricants above, or 0.5% by weight of the reference materials, with 0.2% by weight of graphite and 99.3% by weight of DistaloyAE®. These compositions were used for producing cylindrical samples used to evaluate the lubricating properties and obtained green densities.

For producing iron-based powder compositions aimed to be compacted into green strength bars, and to be tested with respect to powder properties, 0.8% by weight of lubricants and 0.5% of graphite were mixed with 98.7% of ASC100.29.

Powder properties, such as Hall flow and apparent density were measured according to SS-EN 23923-1 and SS-EN 23923-2 for all compositions and the results are disclosed in Table 4.

For testing the maximum height to be compacted without scratches, mixes based on Astaloy®CrM, 0.5% of graphite and 0.6% of lubricants were prepared.

TABLE 4

Iron-based powder compositions and flow and AD thereof.

| Lubricant (%) | Lub. % by wt | Graphite % by wt | Distaloy ® AE % by wt | Flow sec/50 g | AD |
|---|---|---|---|---|---|
| 75/25 EBS/O[2] | 0.5 | 0.2 | 99.3 | 33 | 2.97 |
| 75/25 EBS/A | 0.5 | 0.2 | 99.3 | 29 | 3.02 |
| 100 EBS[2] | 0.5 | 0.2 | 99.3 | 34 | 3.02 |
| 90/10 EBS/E | 0.5 | 0.2 | 99.3 | 34 | 3.02 |
| 85/15 EBS/E | 0.5 | 0.2 | 99.3 | 29 | 3.08 |
| 80/20 EBS/E | 0.5 | 0.2 | 99.3 | 30 | 3.08 |
| 75/25 EBS/E | 0.5 | 0.2 | 99.3 | 30 | 3.07 |
| 60/40 EBS/E | 0.5 | 0.2 | 99.3 | 31 | 3.05 |
| 40/60 EBS/E | 0.5 | 0.2 | 99.3 | No flow | 2.98 |
| 100 E[2] | 0.5 | 0.2 | 99.3 | No flow | 2.98 |
| 75/25 EBS/B | 0.5 | 0.2 | 99.3 | 30 | 3.07 |
| Amide Wax PM[1] | 0.5 | 0.2 | 99.3 | 35 | 3.02 |
| Kenloube ®[1] | 0.5 | 0.2 | 99.3 | 29 | 3.15 |

[1]Reference samples
[2]Outside the scope of the invention

Table 4 shows that excellent flow values and a high AD may be obtained by using the lubricant according to the invention. The values of these parameters were affected by both the relative concentrations of EBS and fatty acid amide as well as the amount of carbon atoms in the fatty acid amide. The mixture containing a fatty acid amide having 18 or less carbon atoms showed bad (high) flow values and low AD, the same can also be seen for 100% fatty acid bisamide and 100% primary fatty acid amide.

Compaction

The iron-based powder compositions based on Distaloy®AE were transferred to a compaction die and compacted at 800 MPa at various temperatures of the die, into cylinders having a diameter of 25 mm and a height of 20 mm.

During the ejection, the ejection energies and the ejection peak forces needed for ejecting the cylinders from the die were measured.

The densities of the green cylinders were also measured according to SS-EN ISO 3927. The tendency for powder to stick on the surfaces of the cylinders was visually evaluated.

For testing green strength, compositions based on ASC100.29 were compacted into green strength bars at a compaction pressure of 600 MPa. The green strengths were measured according to SS-EN 23995.

FIGS. 1-4 and Table 5 disclose the results of the measurements.

TABLE 5

Tendency of sticking after compaction at 800 MPa and at different temperatures.

| Lubricant | Die temp ° C. | Powder sticking on surface |
|---|---|---|
| 75/25 EBS/O[2] | 60 | no |
| " | 70 | yes |
| " | 80 | yes |
| " | 90 | yes |
| 75/25 EBS/A | 60 | no |
| " | 70 | no |
| " | 80 | no |
| " | 90 | no |
| 100 EBS[2] | 60 | no |
| " | 70 | no |
| " | 80 | no |
| " | 90 | no |
| 90/10 EBS/E | 60 | no |
| " | 70 | no |
| " | 80 | no |
| " | 90 | no |
| 85/15 EBS/E | 60 | no |
| " | 70 | no |
| " | 80 | no |
| " | 90 | no |
| 80/20 EBS/E | 60 | no |
| " | 70 | no |
| " | 80 | no |
| " | 90 | no |
| 75/25 EBS/E | 60 | no |
| " | 70 | no |
| " | 80 | no |
| " | 90 | yes |
| 60/40 EBS/E | 60 | no |
| " | 70 | no |
| " | 80 | no |
| " | 90 | yes |
| 40/60 EBS/E | 60 | no |
| " | 70 | no |
| " | 80 | yes |
| " | 90 | yes |
| 100 E[2] | 60 | no |
| " | 70 | no |
| " | 80 | yes |
| " | 90 | yes |
| Amide wax PM[1] | 60 | no |
| " | 70 | no |
| " | 80 | no |
| " | 90 | no |
| Kenolube ®[1] | 60 | no |
| " | 70 | yes |
| " | 80 | Yes |
| " | 90 | yes |

[1]Reference samples
[2]Outside the scope of the invention

Table 5 shows that the iron-based powder compositions including the particulate composite lubricants according to the invention can be compacted at room temperature and elevated temperatures up to at least and including 80° C. (below 90° C.) without rendering powder to stick on the surface of the component.

Figure 2:
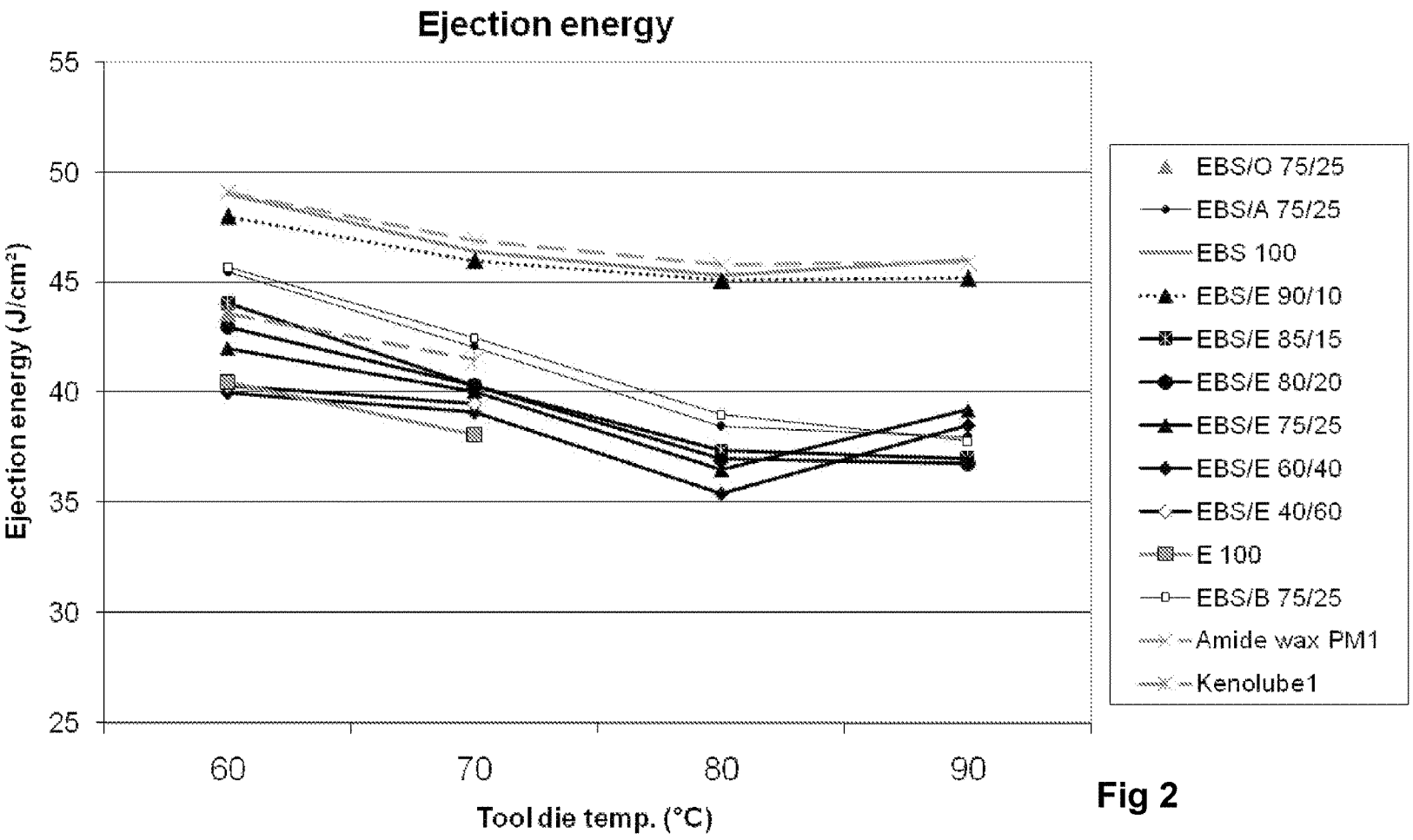
FIG. 2 is graph showing the obtained ejection energy for different lubricant composites at different tool die temperatures.
Figure 3:
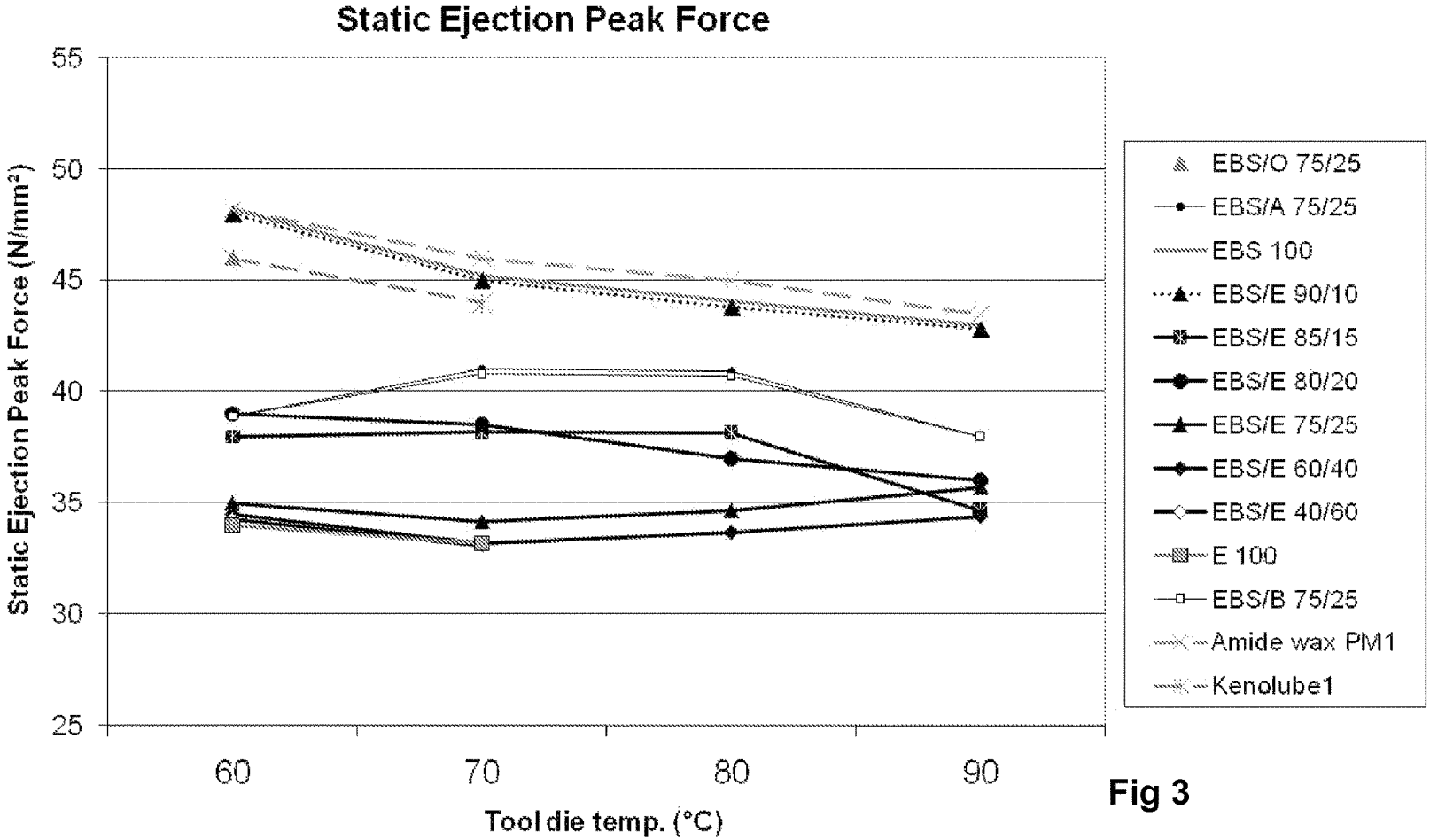
FIG. 3 is a graph showing the static ejection peak force for different lubricant composites at different tool die temperatures.
Figure 4:
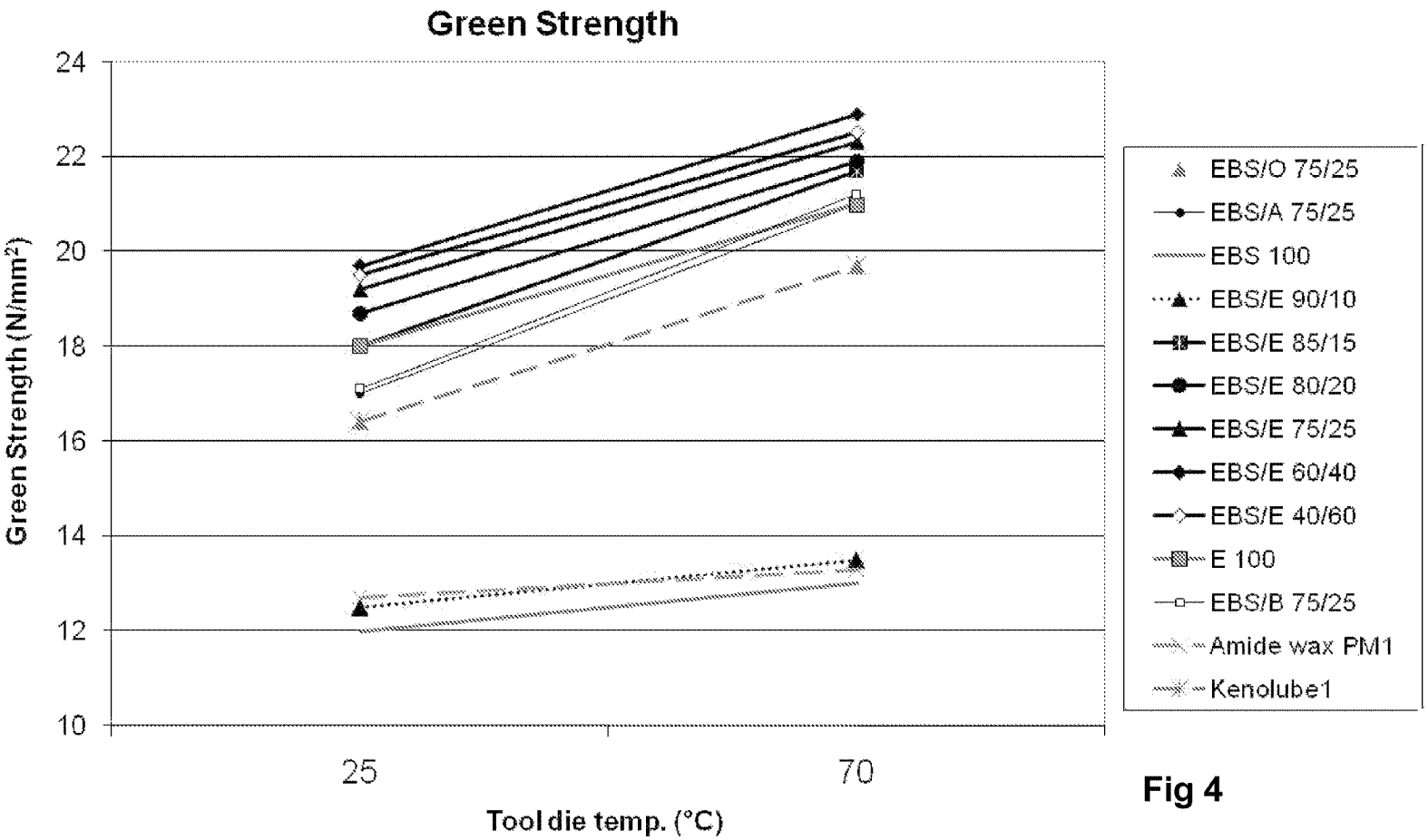
FIG. 4 is a graph showing the obtained green strength for different lubricant composites at different tool die temperatures.

The measured ejection energy and ejection peak force are lower, especially at elevated temperatures, when ejecting components made by the composition according to the invention compared to reference compositions and compositions comprising composite lubricants outside the scope of the present invention, see FIGS. 2 and 3. The same tendency can be noted for the green density which, however, increases at elevated temperatures, see FIG. 1. Higher green strength is recorded for components made of iron-based powder compositions including the particulate composite lubricant according to the invention compared to reference compositions, see FIG. 4.

The maximum height possible to compact without scratches on the component was investigated. Rings having an inner diameter of 20 mm and an outer diameter of 40 mm were compacted, the height was varied in the range between 25-50 mm. Before compaction at 600 MPa, the tool die was heated to 60° C. The evaluation was started with rings having a height of 25 mm and 30 parts were pressed, thereafter the height was increased in increments of 2.5 mm and another 30 parts of each height were pressed. This procedure was repeated until the height was reached where scratches appeared on the surface of the parts, which was an indication of insufficient lubrication. The maximum height possible to compact having scratch free surface was determined and is presented in table 6.

TABLE 6

Maximum height

| Lubricant (%) | Maximum height of component possible to compact without scratches (mm) |
|---|---|
| 75/25 EBS/O[2] | 42.5 |
| 75/25 EBS/A | 40.0 |
| 100 EBS[2] | 27.5 |
| 90/10 EBS/E | 27.5 |
| 85/15 EBS/E | 47.5 |
| 80/20 EBS/E | 47.5 |
| 75/25 EBS/E | 47.5 |
| 60/40 EBS/E | 50.0 |
| 40/60 EBS/E | 42.5 |
| 100 E[2] | 35.0 |
| 75/25 EBS/B | 47.5 |
| Amide Wax PM[1] | 27.5 |
| Kenloube ®[1] | 42.5 |

[1]Reference samples
[2]Outside the scope of the invention

The overall performance of the lubricants were evaluated by assigning a mark for each property, between 1 to 5, where 5 was the highest mark. The following table 7 shows the criteria for assigning the marks.

TABLE 7

The explanation of the overall performance of the materials (5 excellent, 1 not so good)

| Property/Mark | 1 | 2 | 3 | 4 | 5 |
|---|---|---|---|---|---|
| Storages 28 days of lube w % > 150 μm of (%) | >14 | 14-7.0 | 6.9-1.1 | 1.0-0.02 | <0.02 |
| Flow (sec/50 g) | No flow | 40-36 | 35-31 | 30-28 | <28 |
| AD (g/cm$^3$) | <2.94 | 2.94-2.99 | 3.00-3.05 | 3.06-3.11 | >3.12 |
| Powder sticking on surface | Yes | | | | No |
| Green strength (N/cm$^2$) | 12.0-14.0 | 14.1-16.0 | 16.1-18.0 | 18.1-20.0 | 20.1-22.0 |
| Green Density (g/cm$^3$) | <7.34 | 7.34-7.36 | 7.37-7.39 | 7.40-7.42 | >7.42 |
| Ejection energy (J/cm$^2$) | 50.0-45.1 | 45.0-42.1 | 42.0-39.1 | 39.0-36.1 | 36.0-33.0 |
| Ejection Force (N/mm$^2$) | 50.0-43.1 | 43.0-40.1 | 40.0-37.1 | 37.0-34.1 | 34.0-31.0 |
| Maximum height (mm) | 25.0-27.5 | 30.0-35.0 | 37.5-40.0 | 42.5-45.0 | 47.5-50.0 |

TABLE 8

The overall performance.

| Lubricant (%) | Overall performance |
|---|---|
| 75/25 EBS/O[2] | 52 |
| 75/25 EBS/A | 83 |
| 100 EBS[2] | 60 |
| 90/10 EBS/E | 61 |
| 85/15 EBS/E | 90 |
| 80/20 EBS/E | 92 |
| 75/25 EBS/E | 92 |
| 60/40 EBS/E | 95 |
| 40/60 EBS/E | 73 |
| 100 E[2] | 65 |
| 75/25 EBS/B | 86 |
| Amide Wax PM[1] | 59 |
| Kenloube ®[1] | 60 |

[1]Reference samples
[2]Outside the scope of the invention

In FIGS. 1-4 results from samples including reference lubricants and samples including lubricants outside the scope of the invention are shown in grey colour and results from samples including lubricants according to the invention are shown in black. For the sample 75/25 EBS/O only a value at 60° C. is shown and for Kenolube® only at 60 and 70° C., as the lubricating film at higher temperatures were not efficient to enable ejection of the compacted parts from the tool.

The measured ejection energy and static ejection peak force are lower, especially at elevated temperatures, when ejecting components made by the composition according to the invention compared to reference compositions and compositions comprising composite lubricants outside the scope of the present invention, see FIGS. 2 and 3. The same tendency can be noted for the green density which, however, increases at elevated temperatures, see FIG. 1. Higher green strength is recorded for components made of iron-based powder compositions including the particulate composite lubricant according to the invention compared to reference compositions, see FIG. 4.

Figure 5:
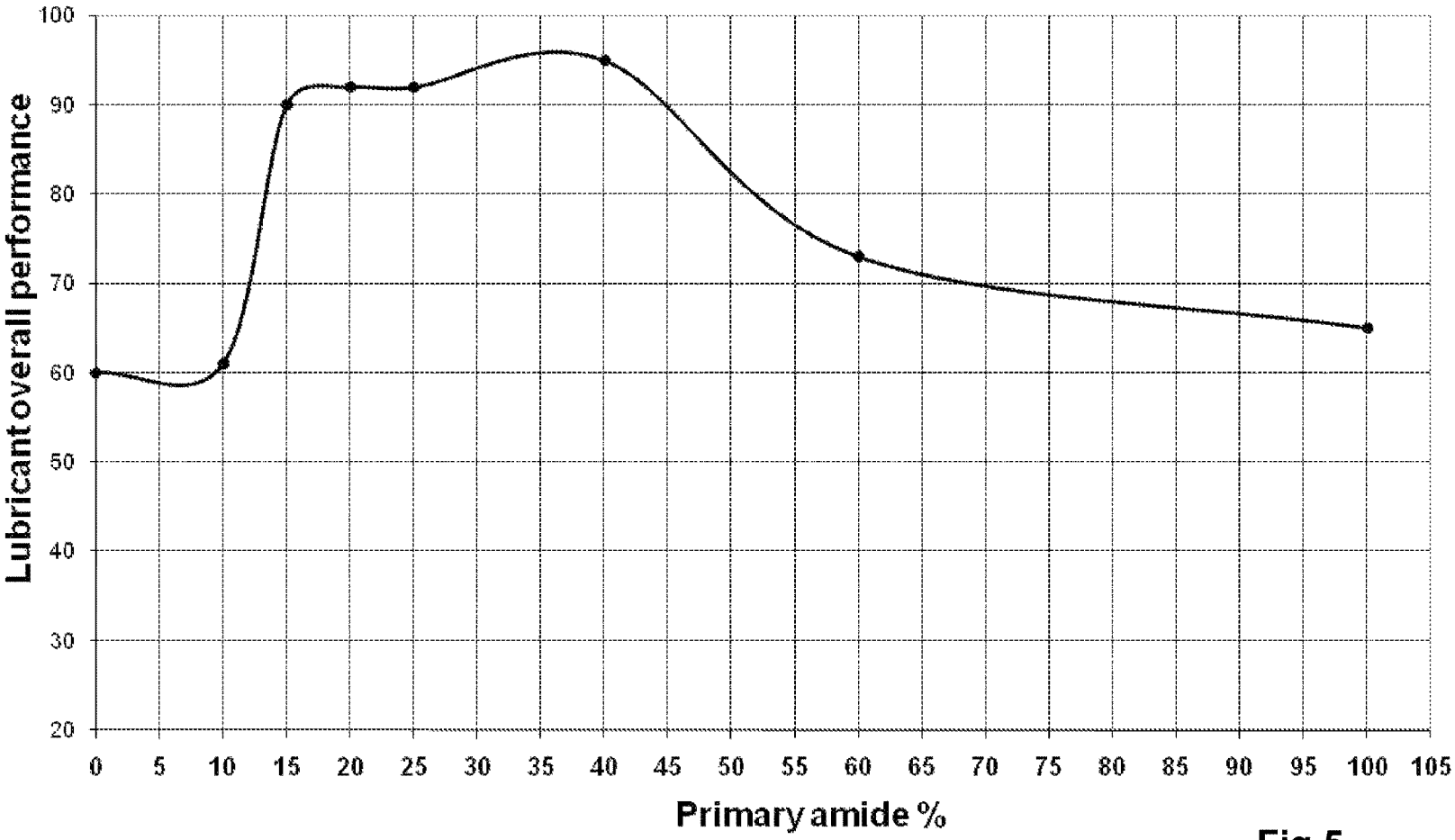
FIG. 5 is a graph showing the overall performance of different lubricant composites.

FIG. 5 plots the overall performance marks of Table 8 for the samples including the primary amide erucic acid amide (E), as well as the sample with 100% EBS, against the concentration of E in the composite lubricant cores. As can be seen in the table, the highest marks are obtained when the concentration of the primary amide is above 10% and up to 60% by weight.

The invention claimed is:

1. An iron-based powder metallurgical composition comprising an iron or iron-based powder and composite lubricant particles, each composite lubricant particle of said composite lubricant particles consisting of:

a core of 10-60% by weight of at least one primary fatty acid amide having more than 18 and not more than 24 carbon atoms and 40-90% by weight of at least one fatty acid bisamide, and nanoparticles of at least one metal oxide adhered on the core, wherein said composite lubricant particles are produced by:

mixing 10-60% by weight of at least one primary fatty acid amide having more than 18 and not more than 24 carbon atoms and 40-90% by weight of at least one fatty acid bisamide; melting the mixture; disintegrating the mixture to form cores of composite lubricant particles; and adhering nanoparticles of at least one metal oxide on the cores, and wherein the at least one metal oxide in the composite lubricant particles is present in a range of 0.001-10% by weight of the composite lubricant particles.

2. The composition according to claim 1, wherein the at least one primary fatty acid amide is 10-40% by weight and the at least one fatty acid bisamide is 60-90% by weight.

3. The composition according to claim 1, wherein the at least one 70-90% by weight.

4. The composition according to claim 1, wherein the at least one fatty acid bisamide is selected from the group consisting of methylene bisoleamide, methylene bisstearamide, ethylene bisoleamide, hexylene bisstearamide, and ethylene bisstearamide.

5. The composition according to claim 1, wherein the nanoparticles of the at least one metal oxide are selected from the group consisting of $TiO_2$, $Al_2O_3$, $SnO_2$, $SiO_2$, $CeO_2$, and indium titanium oxide.

6. The composition according to claim 1, wherein the nanoparticles have a primary particle size of less than 500 nm.

7. The composition according to claim 1, wherein the composite lubricant particles are present in the composition in a concentration of between 0.01-2% by weight of the composition.

8. A particulate composite lubricant particle consisting of:

a core of 10-60% by weight of at least one primary fatty acid amide having more than 18 and not more than 24 carbon atoms and 40-90% by weight of at least one fatty acid bisamide, and nanoparticles of at least one metal oxide adhered on the core, wherein said composite lubricant particle is produced by:

mixing 10-60% by weight of at least one primary fatty acid amide having more than 18 and not more than 24 carbon atoms and 40-90% by weight of at least one fatty acid bisamide; melting the mixture; disintegrating the mixture to form a core of a composite lubricant particle; and adhering nanoparticles of at least one metal oxide on the core, and wherein the at least one metal oxide in the composite lubricant particle is present in a range of 0.001-10% by weight of the composite lubricant particle.

9. The composition according to claim 2, wherein the at least one fatty acid bisamide is selected from the group consisting of methylene bisoleamide, methylene bisstearamide, ethylene bisoleamide, hexylene bisstearamide, and ethylene bisstearamide.

10. The composition according to claim 3, wherein the at least one fatty acid bisamide is selected from the group consisting of methylene bisoleamide, methylene bisstearamide, ethylene bisoleamide, hexylene bisstearamide, and ethylene bisstearamide.

11. The composition according to claim 2, wherein the nanoparticles of the at least one metal oxide are selected from the group consisting of $TiO_2$, $Al_2O_3$, $SnO_2$, $SiO_2$, $CeO_2$, and indium titanium oxide.

12. The composition according to claim 3, wherein the nanoparticles of the at least one metal oxide are selected from the group consisting of $TiO_2$, $Al_2O_3$, $SnO_2$, $SiO_2$, $CeO_2$, and indium titanium oxide.

13. The composition according to claim 2, wherein the nanoparticles have a primary particle size of less than 500 nm.

14. The composition according to claim 1, wherein the concentration of the at least one metal oxide in the composite lubricant particles is 0.01-5% by weight.

15. The composition according to claim 1, wherein the concentration of the at least one metal oxide in the composite lubricant particles is 0.01-2% by weight.

16. The composition according to claim 1, wherein the nanoparticles have a primary particle size of less than 200 nm.

17. An iron-based powder metallurgical composition comprising an iron or iron-based powder and composite lubricant particles, each composite lubricant particle of said composite lubricant particles consisting of:

a core of 10-60% by weight of at least one primary fatty acid amide having more than 18 and not more than 24 carbon atoms and 40-90% by weight of at least one fatty acid bisamide, and nanoparticles of at least one metal oxide adhered on the core; wherein the composite lubricant particles are produced by mixing the primary fatty acid amide and the at least one fatty acid bisamide, melting the mixture, disintegrating the mixture to form the cores of the composite lubricant particles, and adhering the nanoparticles of at least one metal oxide on the cores.

* * * * *